United States Patent [19]

Valentine

[11] 4,126,651

[45] Nov. 21, 1978

[54] PRODUCTION OF PLASTER MOLDS BY MICROWAVE TREATMENT

[75] Inventor: James M. Valentine, Vandalia, Ohio

[73] Assignee: Valentine Match Plate Company, Dayton, Ohio

[21] Appl. No.: 780,024

[22] Filed: Mar. 22, 1977

Related U.S. Application Data

[63] Continuation-in-part of Ser. No. 609,305, Sep. 2, 1975, abandoned, which is a continuation-in-part of Ser. No. 419,580, Nov. 28, 1973, abandoned, which is a continuation-in-part of Ser. No. 253,204, May 15, 1972, abandoned.

[51] Int. Cl.[2] ..... H05B 9/00

[52] U.S. Cl. ..... 264/25; 164/45; 164/250; 264/86

[58] Field of Search ..... 264/25, 86; 106/110; 164/250, 45

[56] References Cited

U.S. PATENT DOCUMENTS

| | | | |
|---|---|---|---|
| 3,585,258 | 6/1971 | Levinson | 264/25 |
| 3,732,048 | 5/1973 | Guerga et al. | 264/25 |

*Primary Examiner*—Robert F. White
*Assistant Examiner*—John A. Parrish
*Attorney, Agent, or Firm*—Biebel, French & Nauman

[57] ABSTRACT

Metal casting components, e.g. molds and cores, are produced from a compacted mass of plaster by microwave treatment while shielded by a heat insulating medium, e.g. glass fiber matting, which freely transmits microwave radiation as well as water vapor and steam. A casting component dried by this method is completely calcined, and the resulting component will promote cast reproduction of its surface pattern with maximum fidelity of detail.

8 Claims, No Drawings

PRODUCTION OF PLASTER MOLDS BY MICROWAVE TREATMENT

CROSS-REFERENCE TO RELATED APPLICATIONS

This application is a continuation-in-part of my application Ser. No. 609,305 filed Sept. 2, 1975 and now abandoned. Reference is also made to my Patent No. 4,043,380, issued Aug. 23, 1977 on application Ser. No. 609,617 filed Sept. 2, 1975 as a continuation in part of my application Ser. No. 419,580 filed Nov. 28, 1973 now abandoned which is a continuation in part of my application Ser. No. 253,204 filed May 15, 1972 and now abandoned.

BACKGROUND OF THE INVENTION

It has been common practice for some time in the foundry industry to fabricate molds and cores, for use in casting metal parts, from commercial metal casting "plaster" which is a blend commonly comprising at least 50% gypsum plaster with the balance being primarily fibrous talc and some silica sand. Such molds and cores are conventionally used with a variety of metals which melt at temperatures substantially above the boiling point of water but below the melting point of gypsum, 2640° F., typical examples being aluminum and its alloys with melting points in the range of 1050°-1200° F., zim base alloys which melt around 900° F. and unleaded bronzes with a melting range of 1800°-1900° F.

In fabricating molds and cores for such uses, the commercial plaster is mixed with a large amount of water, for example an equal or greater amount of water, to produce a highly fluid suspension which is capable of completely filling even relatively complex patterns in the master mold or pattern. Then this large amount of water must be substantially completely eliminated, because any water which remains in the plaster can spoil a casting made therefrom, when it turns to steam upon contact with the molten metal at the elevated temperatures noted above, either by producing surface defects or by virtually exploding portions of the mold.

Drying of a plaster casting component by conventional methods is tedious and of unpredictable reliability in results, particularly if the component is complex or of substantial mass. One reason for these difficulties is that the gypsum component of the plaster normally retains a significant amount of water of crystalization, which cannot be eliminated without heating the entire component to a temperature greater than its calcining temperature of 270° F. This is a very time-consuming operation with a conventional baking furnace, which can easily require as much as 30 hours at 300° F., and even then, the probabilities are that a substantial proportion of a given plurality of components will crack or craze sufficiently to be unusable.

Attempts have been made to dry plaster casting components by exposure to microwave radiation in a microwave oven, on the premise that the known absorption capabilities of water for microwave radiation should make microwave heating an effective drying procedure for the plaster. Strangely, however, these attempts have not been successful, even when the mold or core is heated far beyond the normal 300° temperature obtained in a conventional oven, for example even as high as 600° F. While a mold or core dried in this manner appears to be completely dry, when it is then used for casting, sufficient additional water is given off by the plaster to spoil the majority of the castings. Additionally, heating to such high temperature ranges will usually cause cracks or crazing in a significant portion of the components which make them useless for casting purposes.

My above cross-referenced application discloses that casting components formed of commercial metal casting plaster can be dried very satisfactorily, very much more quickly than by conventional methods, and with minimal damage to the structure of the component itself and to its surfaces, if the wet-molded component is subjected to a two-stage microwave radiation treatment with an intermediate cooling step. More specifically, it appears that the water is effectively eliminated, i.e. the casting component is completely calcined, without loss of its strength or surface characteristics, when the microwave treatment is carried out only until the internal temperature of the component slightly exceeds 300° F., followed by cooling to a temperature of not more than 200° F., and then by a further microwave treatment which raises the temperature throughout the component to about 300° F.

The success of this procedure apparently derives from the fact that during the first microwave treatment, the free water throughout the casting component is driven off, but while the water of crystalization in the central zones of the component is caused to migrate to the surface zones, it is not driven off because the surface of the component is sufficiently cooled by evaporation, of the free water, and also by radiation of heat to the normally cold walls of a microwave oven, to prevent the surface temperature from reaching the calcining range except after such prolonged treatment and resultant high internal temperatures as will "dead burn" or destroy the strength of the plaster of the central zones of the component. The second microwave treatment after cooling causes the water to be driven off from the surface zones of the component before the surface has been cooled by evaporation, and also before the central zones of the component can be reheated to the point of damage.

SUMMARY OF THE INVENTION

The present invention provides a process for fabricating foundry casting components, i.e. molds and cores, from gypsum-containing plaster in accordance with which such components can be dried by a single stage microwave radiation treatment as satisfactorily as, and even more quickly than, by the method of my referenced application. This invention is based on the discovery that if such a casting component is subjected to microwave radiation while it is insulated by a medium which is pervious to both the radiation and to water vapor, but which substantially prevents heat radiation from the surface of the component, the water will be completely eliminated from the component without developing such high temperatures in the interior of the component as will dead burn the plaster. For example, the process of the invention has been performed completely satisfactorily when the microwave treatment is carried out while the casting component is substantially completely covered by glass fiber mats of the type commonly used in the insulation of domestic housing and the like.

When the process of the invention is carried out in this manner, the elimination of the water is essentially continuous until the casting component is completely calcined. This appears to result from the fact that with the heat prevented from radiating away from the component while the water vapor and steam are allowed to escape freely, the surfaces of the component remain hot enough for continuous driving off of water until the calcining operation is complete. This process can therefore be carried out successfully with multiple-part molds while the mold parts are closed, because the calcining operation is continuous and essentially uniform throughout the mold mass.

Whatever the scientific reasons may be, the significant result is that when a plaster casting component has been treated by microwave radiation as outlined above, it produces a perfect casting, free of the defects which commonly result from an incompletely dried plaster mold or core. Further, this advantageous result is obtained with the additional benefit that the time required is a minor fraction of the time necessary when a conventional baking oven is used. An even more important advantage is that plaster molds have been produced in this manner in much greater sizes and with much higher fidelity as to reproduction of detail than has previously been possible using conventional drying methods, with the further outstanding advantage that such molds have been produced with substantial freedom from the cracking and surface crazing which are common disadvantages of conventionally dried plaster molds, and especially without impairment of the strength of the components in the manner caused by the prolonged heating otherwise needed to effect comparably through drying.

DESCRIPTION OF THE PREFERRED EMBODIMENT

An example of the type of product for which the invention offers special advantages is a plaster mold from which to make metal castings which will in turn be used to produce plastic parts or sheet material having intricate surface pattern characteristics, such as wood grain or the appearance of leather or fabric. Such plaster molds are desirably of relatively large size to provide correspondingly large working areas, and they are extremely difficult to produce by conventional methods because of the tendencies of large plaster molds to crack or craze during conventional drying treatment.

In the practice of the invention, molds of such characteristics are produced by the following steps:

1. Prepare a mold pattern having the desired surface texture to be produced, as by lining the bottom of the cavity with a wood grained pattern whose surface is to be reproduced;
2. Spray the surface of the pattern lightly with an oil or other conventional release agent;
3. Fill the mold cavity with the proper mixture of water and plaster, preferably using 40–50% dry plaster blend and 50–60% water;
4. Allow the plaster to set, which normally requires only about ten minutes;

These first four steps are conventional, and other conventional preliminary steps may be used. Thus if the final product is to be a female (negative) mold for producing multiple reproductions of an original piece, the mold pattern referred to in step 1 is commonly produced by a rubber-like commercial molding compound which is applied to the original piece and can then be peeled away as a negative reproduction of the original.

5. Remove the set plaster mold mass from the mold cavity and place it in a microwave oven;
6. Cover all exposed surface areas of the mass with glass fiber matting of a thickness of at least 1 inch;
7. Apply microwave radiation until the internal temperature of the mass is in the range of 350°–400° F.;
8. Discontinue heating and the mold is now ready to use for casting the metal part therefrom.

Plaster molds produced as outlined above have been found to possess all necessary strength characteristics as well as high fidelity of detailed reproduction of the original pattern surface, free of cracks, crazing, and other surface and structural defects. The time necessary to dry a plaster mold mass of a size requiring 35 to 40 hours in a conventional oven is only 3 to 10 hours for the process of the invention. In addition, when similar plaster molds are attempted to be produced by conventional heating treatments, the rate of failure by reason of cracking or crazing often exceeds 50%. It is also significant that when a similar plaster mold was subjected to a single microwave treatment by which its temperature was raised far above 320° F., e.g. 600° F., it still retained an undesirable amount of water, and it also was wholly lacking in the necessary strength as compared with the product of the insulated microwave treatment of the invention.

While glass fiber matting insulation has proved highly satisfactory, as well as easy to use as described above, the one-inch thickness noted above is only an example of matting which is readily commercially available, and lesser thickness can also be used. It is also possible to use other types of insulation to prevent radiation of heat from the casting component so long as they will transmit microwave radiation and permit the escape of water vapor and steam from the component during the microwave treatment. For example, the insulation medium may comprise ceramic plates or other solid members of refractory material, such as bricks, capable of freely transmitting microwave radiation and which are located in closely spaced relation with the casting component to leave a narrow slot therebetween, such as a slot in the range of a few thousandths of an inch to perhaps a quarter-inch, the objective being to minimize convention current away from the component while permitting steam and water vapor to escape. With such an arrangement, the water vapor or steam readily escapes through the slot while the heat is reflected back into the surface zone of the component so that the desired dehydration of the component will continue until the plaster is completely calcined.

While the times and temperatures specified above are not critical, they typify the preferred range, and there are also some temperature guidelines which should be observed. The microwave treatment should continue until the mass is heated beyond the calcining temperature of gypsum, namely 270°, but if it is permitted to rise as high as 600° F., the internal strength of the mass will be effectively destroyed. As a practical matter of safety, therefore, it should not go significantly higher than 400°, and the range of 350°–400° provides a safe margin as well as effective results.

Highly satisfactory control over the operation of the invention has been established by means of an infrared thermal controller arranged to measure the temperature of the surface within a cavity in the component being dried. For example, if the sprue hole in a multiple-part mold is at a convenient location such that the infrared detector can use it for target purposes, this provides a convenient way of measuring when the surface of the cavity in the mold mass has reached the proper temperature. Alternatively, satisfactory results have been obtained by providing a blind target hole in the side of the mass, e.g. 2–3 inches in diameter and two inches in depth, and in this case, a hole should also be provided in the insulation in line with this target hole so that the infrared detector can measure that surface temperature of the bottom of the hole.

While the method herein described constitutes a preferred embodiment of the invention, it is to be understood that the invention is not limited to this precise method, and that changes may be made therein without departing from the scope of the invention.

What is claimed is:

1. The method of fabricating from gypsum-containing plaster, a foundry casting component which is to be used in casting a metal part from molten casting metal at a temperature above the boiling point of water, and from which the water must be substantially completely eliminated to prevent its turning to steam upon contact with the molten metal, which method comprises the steps of, (a) forming a moldable suspension of the plaster and water, (b) molding a mass of said suspension into a predetermined configuration, (c) shielding said molded mass against radiation of heat therefrom by heat insulating means pervious to microwave radiation and to water vapor and steam; and (d) subjecting said insulated mass to electromagnetic wave energy at microwave frequency until the internal temperature of said mass exceeds the calcining temperature of gypsum but does not reach 600° F.

2. The method defined in claim 1 wherein said calcining temperature is 270° F.

3. The method defined in claim 1 wherein said subjecting step (d) is continued until the internal temperature of said mass is in the range of approximately 350°–400° F.

4. The method defined in claim 1 wherein said insulating means comprises glass fiber matting.

5. The method defined in claim 1 comprising the further step of controlling said subjecting step (d) by measuring with infrared radiation the temperature of the surface of a cavity in said mass.

6. The method defined in claim 5 wherein said mass is a multiple-part mold having a sprue hole leading to a cavity therein and said measuring action is carried out through said sprue hole.

7. The method defined in claim 5 wherein said cavity is a blind hole in the outer surface of said mass.

8. A method defined in claim 1 wherein said insulating means comprises solid members of refractory material located in closely spaced relation with said mass to leave a narrow slot therebetween for escape of water vapor of steam while reflecting heat back into the surface of said mass.

* * * * *